United States Patent [19]

Szyszkowski et al.

[11] 4,294,629

[45] Oct. 13, 1981

[54] DRAWN RODS MADE OF LEAD BRASS AND A PROCESS FOR THE THERMAL TREATMENT THEREOF

[75] Inventors: Adam Szyszkowski, Tignieu; Marc Moreau, Asnieres; Pierre Priester, Paris, all of France

[73] Assignee: Trefimetaux, Clichy, France

[21] Appl. No.: 81,173

[22] Filed: Oct. 2, 1979

[51] Int. Cl.[3] ..... C22F 1/08

[52] U.S. Cl. ..... 148/11.5 C; 148/32

[58] Field of Search ..... 148/11.5 C, 13, 13.2, 148/32

[56] References Cited

U.S. PATENT DOCUMENTS 4,180,398 12/1979 Parikh ..... 148/11.5 C

*Primary Examiner*—R. Dean

*Attorney, Agent, or Firm*—Dennison, Meserole, Pollack & Scheiner

[57] ABSTRACT

A process and article of manufacture relating to drawn rods made of lead brass which has been subjected to at least one intermediate annealing treatment, the invention involves annealing at a temperature of between 425° C. and a temperature which is 10° lower than the solidus point for a period of between 1/100 of a second and one minute. The rods thus obtained contain uncoalesced lead particles having a dimension of less than 1.5 micrometers and contain at least 8000 of these lead particles per square millimeter and for each percent of lead. The rods produce fine shavings during machining and do not cause blocking on breakage. The present lead brass rods are particularly useful for automatic screw thread cutting.

9 Claims, 7 Drawing Figures

DRAWN RODS MADE OF LEAD BRASS AND A PROCESS FOR THE THERMAL TREATMENT THEREOF

BACKGROUND OF THE INVENTION

1. Field of the Invention

The invention generally relates to lead brass material which has been subjected to at least one intermediate annealing treatment, the material being particularly useful for formation of drawn rods having improved machineability. The invention also provides a process for the thermal treatment of drawn lead brass rods, the process involving at least one rapid annealing treatment carried out at a temperature between 425° C. and a temperature which is 10° lower than the solidus point of the brass.

2. Description of the Prior Art

Machining of lead brass rods, particularly by screw-thread cutting, typically produces long shavings which "curl" or wind up, thereby giving rise to the well-known problem of "blocking" which necessitates frequent manual intervention by the operator to clear and clean the work piece and work tool. Lead brass rods are typically formed by a drawing process wherein one or more intermediate annealing treatments occur during the drawing operation. The conventional intermediate annealing treatments, which are carried out in static furnaces or in passage furnaces during drawing operations, distorts the machineability of the brass both with regard to the fineness of the shavings and with regard to life span of the machining tool. This degradation can be attributed to the coalesence of the lead, that is, the gathering of fine inclusions distributed in a substantially uniform manner in the form of globules. It is thus the intent in the art to produce lead brass rods which can be subjected to screw-thread cutting on automatic, high-speed lathes which operate without supervision. The machining of prior art lead brass material gives rise to long shavings which curl and produce the well-known "blocking" effect, thus resulting in the need for frequent manual intervention by the operator. The present invention particularly provides a process for the thermal treatment of drawn rods made of lead brass, this brass material on machining resulting in fine and short shavings which causes the material to be particularly suitable for automatic screw-thread cutting.

SUMMARY OF THE INVENTION

The present invention provides a lead brass article having improved machineability and which produces fine and short shavings when subjected to screw-thread cutting operations. The present lead brass material is seen to be subjected to at least one intermediate annealing treatment which results in the provision in the material of at least 90% of the lead particles having a smallest dimension of less than 1.5 micrometer with the number of lead particles, counted over any cross section, being at least 8000 per square millimeter and for each percentage of lead. The $\alpha$ phase regions of the present material are seen to be constituted by several twinned $\alpha$ grains having an average diameter of less than 25 micrometers. It is to be noted that the present lead brass articles can be rods or wires having small dimensions and having cross-sections of any shape such as round, flat and polygonal and which are inscribed in a circle whose diameter can range from 1 or 2 to 10 or 12 millimeters, these values being given for informational purposes only. As conceived herein, the term "rods" designate brass wires and rods having dimensions and shapes comprised within the approximate limits thus defined.

The present invention also relates to a process for the thermal treatment of drawn rods made of lead brass, the present process being characterized in that, after extrusion and during drawing, at least one rapid annealing treatment is carried out for a period and at a temperature which is sufficient to rule out the cold working effect without causing coalesence of the lead and without substantially altering the structure and distribution of the alpha and beta phases in the case of two-phase brasses and the dimension of the alpha phase grains.

The present annealing treatment is carried out at a temperature between 425° C. and a temperature which is 10° lower than the solidus point of the brass and preferably at a temperature of between 550° and 800° C. for a period of between 1/100 of a second and one minute by direct heating and between one second and ten minutes by indirect heating.

The drawn brass rods of the present invention essentially contain, in addition to copper, from 30 to 42% of zinc and from 1.5 to 4.5% of an element intended to improve machineability, such as lead. The drawn rods can also contain small quantities of optional elements such as up to 2.5% of aluminum, up to 1.3% of tin, from 0.03 to 0.1% of arsenic, and elements which are present as impurities owing to the recycling of scrap materials such as up to 0.1% of iron and up to 0.01% of silicon. The structure of the present rods can be mono-phase alpha or di-phase alpha plus beta.

Accordingly, it is an object of the present invention to provide a process for the thermal treatment of lead brass rods having improved machineability, thus producing fine and short shavings on machining to particularly allow the greater use of automatic screw-thread cutting equipment for machining of the material.

It is also an object of the invention to provide a process for the thermal treatment of drawn rods formed of lead brass, the present process comprising, after extrusion and during drawing, at least one rapid annealing treatment carried out for a period and at a temperature which is sufficient to rule out the cold working effect and to prevent coalesence of the lead in the material. It is a further object of the invention to provide a process for the thermal treatment of drawn rods made of lead brass wherein the annealing treatment is carried out at a temperature between 425° C. and a temperature which is 10° lower than the solidus point of the brass.

Further objects and advantages of the invention will become more readily apparent in light of the following detailed description of the preferred embodiments.

DESCRIPTION OF THE PREFERRED EMBODIMENTS

Figure 1:
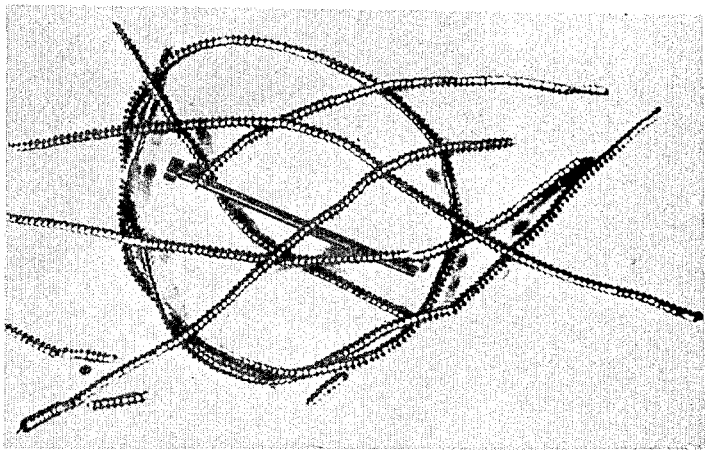
FIG. 1 is a photo micrograph illustrating the shape of brass shavings obtained with the use of prior art material produced by prior art processes.
Figure 2:
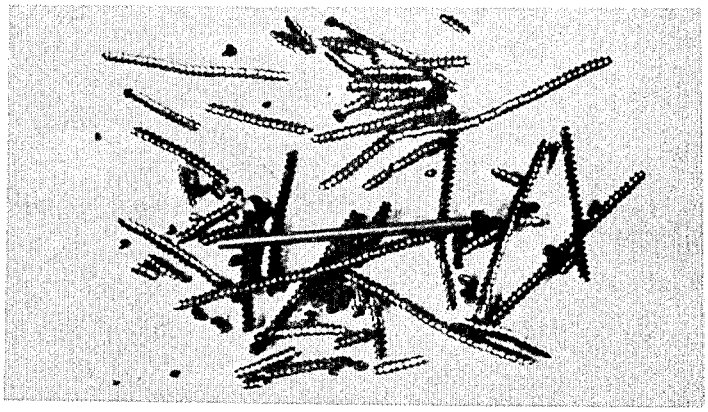
FIG. 2 is a photo micrograph of brass shavings formed from a machined prior art brass material produced by a differing prior art process than that of FIG. 1.
Figure 3:
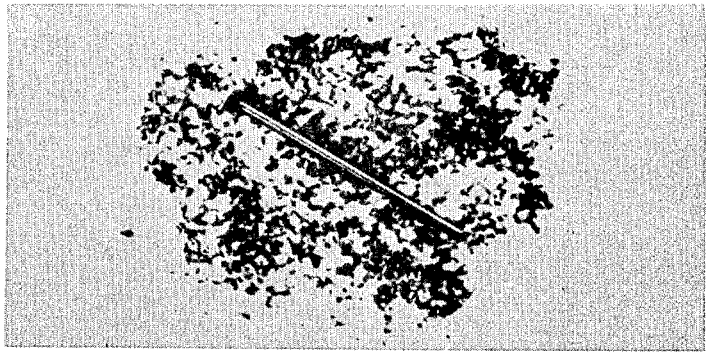
FIG. 3 is a photo micrograph illustrating the shape of brass shavings obtained from machining of a material according to the present invention which is produced by the process of the present invention.

Referring now to FIGS. 1 through 3, the advantages of the present process for the thermal treatment of drawn lead brass rods can be appreciated in view of a comparison of prior art transformation cycles and a transformation cycle accomplished according to the present invention. In particular, a brass comprised of 57% copper, 40% zinc, and 3% lead was extruded in a billet form to a diameter of 5.8 millimeters, the 5.8 millimeter rod then being drawn to a diameter of 5.2 millimeters. The small drawn rod was then divided into three batches which were subjected to three different transformation cycles, cycles A and B being accomplished according to the prior art and cycle C being accomplished according to the teachings of the present invention.

In cycle A, a first batch of rods was subjected to static annealing for three hours at 610° C. followed by drawing to a diameter of 4.8 millimeters and annealing for three hours at 610° C., again followed by drawing to a diameter of 4 millimeters.

Cycle B involved annealing of a second batch of rods for one and a half hours in a passage furnace regulated to 550° C. followed by drawing to a diameter of 4.8 millimeters. A second annealing step was then performed for 1½ hours and a passage furnace regulated to 550° C., followed by drawing to a diameter of 4 millimeters.

Cycle C, a process according to the present invention, comprised rapid annealing by the Joule effect (passage of an electric current of the order of 2000 amperes for 2.75 seconds), the annealing step being followed by water quenching. The rods were then drawn to a diameter of 4.8 millimeters and again subjected to rapid annealing as described, this rapid annealing step being followed by a drawing of the rods to a diameter of 4 millimeters.

The mechanical characteristics of each of the products were then measured, these characteristics being summarized in Table 1 as follows:

TABLE I

| | TS in MPa | YS in MPa | E over 1 = 5 d |
|---|---|---|---|
| Cycle A | 544 | 483 | 10% |
| Cycle B | 560 | 510 | 15% |
| Cycle C | 622 | 519 | 15% |

It is seen that the mechanical characteristics of the products produced by cycles A through C differ only slightly. It is seen that rapid annealing by the Joule effect leads to a slightly higher tensile stress and yield stress. However, all of the processes produce essentially the same degree of elongation (measured over a length equal to five times the diameter of the product tested). It is to be noted that rapid annealing by the Joule effect can be followed by air cooling instead of by water quenching. Under such circumstances, the values of TS and YS are slightly lower than the values indicated above. Under such circumstances, the degree of elongation will be higher.

The products produced by cycles A through C were tested under sufficiently selective machining conditions to differentiate between the three batches with regard to the shape of the shavings. These conditions are as follows:

| | |
|---|---|
| speed | 100 m/min |
| advance | 0.06 mm/revolution |
| depth of cut | 2 mm over radius |
| tool | carbide |

The shape of the shavings obtained from the batches produced according to cycles A through C are shown in FIGS. 1 through 3. Shavings produced from the products annealed according to cycle A are seen in FIG. 1 while shavings produced from the lead brass rods annealed according to cycle B are seen in FIG. 2. The shavings produced according to cycles A and B are seen to be too large in size, the size of these shavings acting to impede work on an automatic lathe. However, reference to FIG. 3 shows the very fine shavings resulting from machining of the lead brass rods produced by impulse annealing of cycle C, that is, according to the present invention.

As a further example, a brass billet having the same composition as indicated above for the material processed according to cycles A through C was extruded to a diameter of 6.4 millimeters. The 6.4 millimeter rod was then drawn to a diameter of 5.5 mm. The small drawn rod was then divided into four batches which were subjected to four annealing cycles, that is, cycles D, E, F and G, cycles D and E being according to the teachings of the present invention and cycles F and G being according to prior art practice. The processes according to cycles D through G are summarized:

Cycle D: annealing in a salt bath at 700° C. Several tests were carried out on fractions from this batch for periods varying from 15 seconds to 2.5 minutes and with air cooling and water cooling followed by drawing from 5.5 to 5.0 mm.

Cycle E: rapid annealing by the Joule effect with a current of the order of 2000 amperes for 2.75 seconds followed by water quenching followed by drawing from 5.5 to 5.0 mm.

Cycle F: annealing in a static furnace for 3 hours at 610° C. followed by air cooling followed by drawing from 5.5 to 5.0 mm.

Cycle G: annealing for 1 hour in a passage furnace regulated to 550° followed by drawing from 5.5 to 5.0 mm.

Screw-cutting tests using an automatic lathe were then carried out on each batch which had been subjected to cycles D, E, F and G under the following conditions:

| | |
|---|---|
| speed | 8000 rmp, that is to say 125 meters/minute |
| depth of cut | 1.25 mm |
| advance | tests of 0.04–0.06–0.08 and 0.01 mm per revolution |
| lubrication | pure oil |
| tool | carbide |
| principal relief angle | 10° |
| secondary relief angle | 10° |
| secondary edge angle | 10° |
| other angles | 0° |

The results of the screw-cutting tests show that the rapid annealing treatments according to the present invention cause the production on machining of very fine shavings with the results not being affected by the cooling speed following the annealing steps. The results of the screw-cutting tests clearly showed that static annealing and annealing in a passage furnace produced shavings which are overly long and which were considered a nuisance during machining.

According to the present invention, the rapid annealing treatments whether by the Joule effect or in a salt bath did not alter or altered only slightly the distribution of lead relative to that present in the extruded-drawn state. On the other hand, static annealing and annealing in a passage furnace caused lead to coalesce.

It should be understood that the present process is not limited to the use of rapid annealing by the Joule effect or by immersion in a salt bath. The present invention contemplates any method for bringing the brass to a temperature higher than 425° C. for a variable period which is dependent on a temperature selected but which is always below ten minutes. In certain situations, such as during continuous annealing by the Joule effect, it is not always possible to measure the exact temperature continuously. However, the temperature is always taken to be at least 425° C. and generally at least 550° C.

It can generally be stated that processes for elevating the brass rods to be annealed to a temperature of between 425° C. and 10° below the solidus temperature could be classified in two categories, the first category being both processes in which the heat is supplied by an external source such as by radiation and/or convection and/or conduction, these processes being generally referred to as "indirect heating processes." The second class of processes are those in which heat is dissipated in the very heart of the rod to be annealed, these processes being called "direct heating processes" and particularly include the Joule effect (capacitor discharge, induction, etc). The "indirect" processes involve a period of treatment which can range from one second to ten minutes depending on the ratio between the power of the heat source and the calorific capacity of the rods to be annealed. The "direct" processes allow much shorter periods of treatment which can range from 1/100 of a second to one minute.

Processes falling under the first category include treatment in electric resistance furnaces, gas furnaces which operate by radiation or direct action of the flame on the product to be treated, treatment in salt baths, or treatment in fluidized bed furnaces.

The second category includes certain known annealing processes such as are described in U.S. Pat. No. 4,118,617, issued in the name of Trefimetauz, these processes involving the induction of a high frequency current in a loop formed by the product to be annealed, the loop closing in the groove of a pulley where the already annealed and cooled portion of the product is superimposed on the portion which is not yet annealed.

Figure 4:
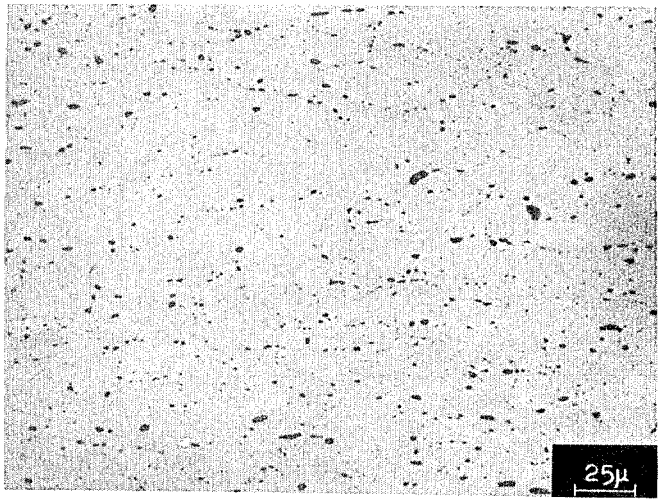
FIG. 4 is a photo micrograph of a lead brass produced by an extruded-drawing process.

Comparative micrographic examination has allowed the lead brass rods formed according to the present, which rods have been subjected to at least one intermediate annealing treatment, to be characterized by the distribution of the lead particles and the structure of the alpha phase. As can be seen in FIG. 4, a fairly regular distribution of the lead particles is seen, these lead particles appearing clearly in black and thus being subject to observation in an extruded and drawn lead brass rod. The lead particles are, on average, less than 1.5 micrometers in size. It is possible to count, on average, 7000 particles per square millimeter and for each percentage of lead in the brass over any cross section.

Figure 5:
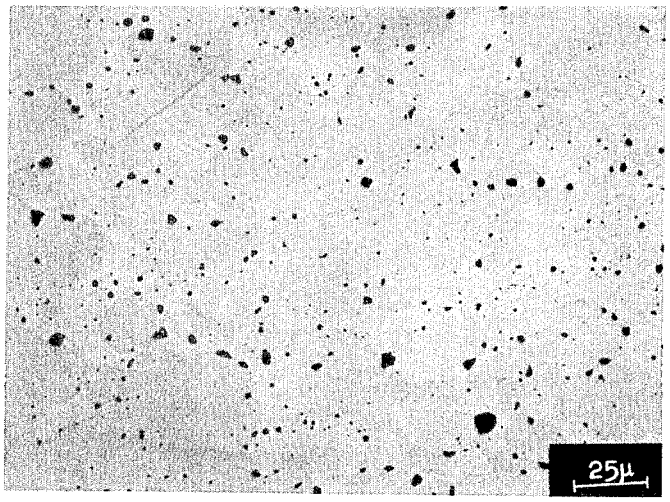
FIG. 5 is a photo micrograph of a lead brass annealed according to a typical prior art process.

After an annealing treatment according to the prior art, such as according to cycles A and B and cycles F and G, it is possible to observe as seen in FIG. 5 significant coalesence of the particles having dimensions which can lie between 3 to 5 micrometers, the number of which has fallen, by correlation, to 3500 per square millimeter and for each percentage of lead contained.

Figure 6:
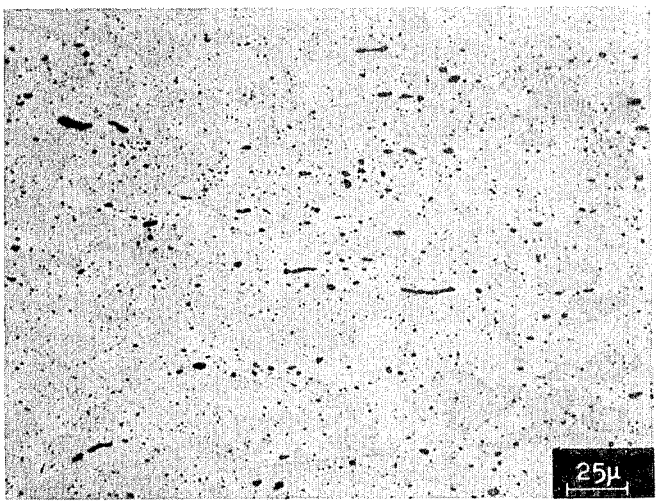
FIG. 6 is a photo micrograph of a lead brass annealed according to the present invention; and, FIG. 7 is a photo micrograph of a lead brass annealed according to the process of the present invention.

FIG. 6 is a photo micrograph of a brass rod which has been subjected to an annealing treatment according to the invention by electrical impulses of 2000 amperes for a period of 2 and 75/100 seconds followed by water quenching. It is observed that 90% of the particles have an average dimension of 1.5 micrometers. The particles are seen to have increased slightly in number, there being at least 8000 per square millimeter and for each percentage of lead. As can also be seen, the alpha phase grains have recrystallized and are twinned strongly. The grains have an average dimension of less than 25 micrometers and are usually less than 20 micrometers whereas this dimension is approximately 40 micrometers after annealing according to the prior art. It is further to be seen that the grains are twinned and that the alpha phase ranges are constituted by several grains.

Figure 7:
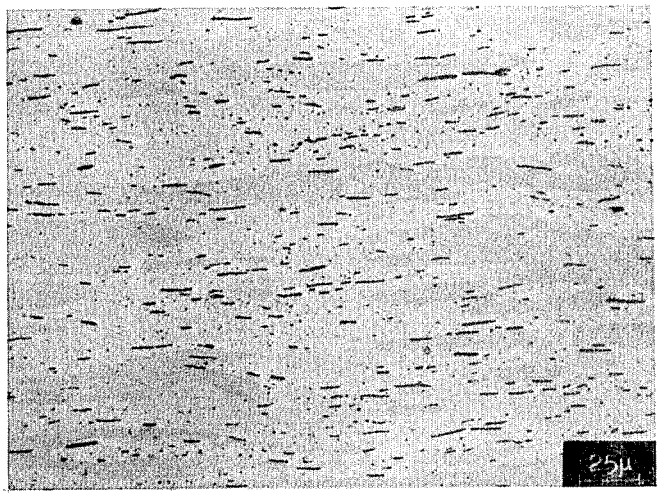

FIG. 7 is a photo micrograph of a brass rod which has been subjected, during drawing, to three intermediate annealing treatments according to the invention, the rods being to diameters of 5.5, 4 and 3 millimeters. Electrical pulses of 2000 amperes for 2 and 75/100 seconds have been used, quenching occuring after each annealing treatment. It is observed that the number and size of lead particles are not substantially altered and remain within the limits indicated above. However, even though certain lead particles tend to assume an elongated shape, the smallest transverse dimension of the particles remains below 1.5 micrometers.

The advantages of the thermal treatment by rapid annealing according to the invention include the possibility of annealing the brass rods directly and continuously at the end of the drawing line. It is to be appreciated that the advantages of the invention are more particularly marked in the case where direct heating processes are used. A substantial improvement in the surface state of the rods is accomplished due to the short residence time at high temperature which, in most cases, causes pickling to be a necessary or at the least simplifies pickling and allows rapid pickling to be carried out continuously, if necessary, by chemical or electrochemical methods. It is seen also that a very substantial increase is observed in the service life of the screw-cutting tools. Finally, due to the excellent homogeneity of the annealing treatment, rods which are much straighter than those obtained by the known processes are obtained during the drawing operation, this being essential for the supply of automatic lathes in which the rods have to roll over an inclined plane without becoming entangled. It is seen that a narrower dimensional tolerance is obtained along the entire length of the rods.

It is to be understood that the invention can be practiced other than explicitly described hereinabove, the invention being designed essentially by the scope of the intending claims.

What is claimed is:

1. In a process for the thermal treatment of drawn copper-zinc-lead brass alloy stock to improve the machinability by ensuring fine short shavings, the improvement which comprises:

providing a billet consisting essentially on the basis of weight percentage

| | |
|---|---|
| zinc | 30 to 42 |
| lead | 1.5 to 4.5 |
| arsenic | ≦0.1 |
| aluminum | ≦2.5 |
| tin | ≦1.3 |
| iron | ≦0.1 |
| silicon | ≦0.01 |
| copper | balance; |

extruding said stock to obtain a blank;

subjecting the blank to a drawing pass to provide stock of a desired final dimension;

subjecting the drawn stock to a rapid annealing comprising heating said drawn stock to a temperature between about 425° C. and about 10° C. below the solidus temperature of the alloy for a period of between about 1/100 of a second and about 10 minutes.

2. A process for the thermal treatment of drawn brass stock according to claim 1, characterized in that the said stock is brought to a temperature of between about 425° C. and about 10° C. below the solidus point of the brass by direct heating such as by Joule effect heating for a period of between about 1/100 of a second and about 1 minute.

3. A process for the thermal treatment of drawn brass stock according to claim 1, characterized in that the said stock is brought to a temperature of between about 550° C. and about 800° C. by indirect heating for a period of between about 1 second and about 10 minutes.

4. A process for the thermal treatment of drawn brass stock according to claim 1, characterized in that the said stock is brought to a temperature of between about 550° C. and about 800° C. by direct heating such as by the Joule effect for a period of between about 1/100 of a second and about 1 minute.

5. Drawn stock of copper-zinc-brass alloy which is $\alpha$-monophase or $\alpha+\beta$ two-phase and has improved machinability due to the ability to produce fine short shavings, which brass consists essentially on the basis of weight percentage of

| | |
|---|---|
| zinc | 30 to 42 |
| lead | 1.5 to 4.5 |
| arsenic | ≦0.1 |
| aluminum | ≦2.5 |
| tin | ≦1.3 |
| iron | ≦0.1 |
| silicon | ≦0.01 |
| copper | balance; |

said drawn stock having been subjected to at least one annealing after drawing by being subjected to a temperature between about 425° C. and about 10° C. below the solidus temperature of the alloy for a period of between about 1/100 of a second and about 10 minutes.

6. The drawn stock of claim 5 wherein the lead is present as particles and at least 90% of the lead particles have their smallest dimension lower than 1.5 micrometers.

7. The drawn stock according to claim 5, wherein the lead is present as particles and the number of lead particles counted over any cross-section is at least about 8000 per square millimeter and for each percent of lead contained.

8. The drawn stock according to claim 5, wherein the lead is present as particles and the $\alpha$ phase grains have an average diameter of less than about 25 micrometers, in that the grains are twinned, and in that the $\alpha$ phase regions are constituted by several grains.

9. The drawn stock of claim 7 wherein the $\alpha$ phase grains have an average diameter of less than about 25 micrometers, the $\alpha$ phase grains being twinned, and the $\alpha$ phase regions are constituted by several grains.

* * * * *